US007631626B1

(12) United States Patent
Zurawski et al.

(10) Patent No.: US 7,631,626 B1
(45) Date of Patent: Dec. 15, 2009

(54) METHOD TO PROTECT STARTER FROM OVERHEATING

(75) Inventors: Mark Allen Zurawski, Northville, MI (US); Marc Christian Allain, Plymouth, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 12/185,576

(22) Filed: Aug. 4, 2008

(51) Int. Cl.
*F02N 11/10* (2006.01)

(52) U.S. Cl. ..... 123/179.3; 123/179.28

(58) Field of Classification Search ..... 123/179.3, 123/179.13, 179.14, 179.15, 179.28; 290/38 R
See application file for complete search history.

(56) References Cited

U.S. PATENT DOCUMENTS 4,490,620 A 12/1984 Hansen
4,494,162 A 1/1985 Eyler
4,653,442 A * 3/1987 Swenson ..... 123/179.3
4,674,344 A 6/1987 Kazino et al.
5,345,901 A 9/1994 Siegenthaler et al.
5,349,931 A * 9/1994 Gottlieb et al. ..... 123/179.2
5,798,577 A * 8/1998 Lesesky et al. ..... 307/10.7
5,970,937 A * 10/1999 Casellato et al. ..... 123/179.3
6,050,233 A * 4/2000 Vilou ..... 123/179.3
6,497,209 B1 12/2002 Karuppana et al.
6,960,897 B2 11/2005 Hisamoto et al.
7,067,934 B2 6/2006 Kitagawa et al.
7,156,064 B2 1/2007 Namari et al.
2007/0063597 A1 3/2007 Nito

* cited by examiner

*Primary Examiner*—Hai H Huynh
(74) *Attorney, Agent, or Firm*—Bill C. Panagos; Rader, Fishman & Grauer PLLC

(57) ABSTRACT

The present invention relates to a method to protect a starter from over heating during any cranking operation to start an electronically controlled internal combustion engine having an electronic control unit with a memory. The method includes constraining the time during which a cranking operation may proceed and ensuring that the starter temperature is within a predetermined range to ensure that the starter does not operate for a time period that permits the starter to heat up beyond a predetermined temperature range.

12 Claims, 2 Drawing Sheets

METHOD TO PROTECT STARTER FROM OVERHEATING

TECHNICAL FIELD

Excessive cranking of starters in internal combustion engine may cause the starter to overheat. The overheating may reduce the starter life, and may ultimately cause the starter to fail. One way to ensure a starter does not overheat is to limit the time duration during which it may be permitted to engage in a cranking operation. Another way is to measure the temperature of the starter and compare it to a predetermined temperature to ensure that the starter does not overheat. If the starter temperature is greater than the predetermined temperature, a relay switch may be used to prevent starter operation until the starter temperature more closely approximates another predetermined temperature threshold.

The present invention relates to a method to protect a starter from over heating during any cranking operation to start an electronically controlled internal combustion engine having an electronic control unit with a memory. The method includes constraining the time during which a cranking operation may proceed and ensuring that the starter temperature is within a predetermined range to ensure that the starter does not operate for a time period that permits the starter to heat up beyond a predetermined temperature range.

SUMMARY OF THE INVENTION

In one embodiment, the present disclosure relates to a method to protect a starter from overheating during cranking operations preparatory to starting an electronically controlled internal combustion engine having an electronic control unit (ECU), and at least one temperature sensor, an ignition switch, a battery connected to a starter and a relay switch between the battery and the starter. The method comprised:

a) determining whether the starter temperature and duration of time an ignition switch is in the "off" position is greater than a predetermined ignition time; based on a prior crank event;

b) approximating the starter temperature with ECU temperature;

c) cranking the starter and determining a change (Δ) in battery voltage between resting and cranking to Δ current;

d) multiply the Δ current by a predetermined coefficient to convert to Δ temperature and add to Δ temperature to a last starter temperature stored in memory;

e) ceasing starter operation and bringing starter temperature to approximate ECU temperature;

f) disabling the starter if the starter temperature is above a predetermined temperature until the starter is at or below another predetermined temperature. The starter may be disabled by opening a relay switch between the vehicle battery and the starter to prevent current flow to the starter for a predetermined period of time until the starter has cooled to another predetermined temperature or until a predetermined period of time has elapsed since the last starter activation event.

Generally, the starter is disabled for a period of time 4 times greater than the period of time wherein it is activated and cranking the engine. The prior crank event is measured by a countdown relay, stored in memory of the ECU that is not reset until the next ignition event.

The method further includes determining whether the last stored starter temperature and duration of ignition is greater than a predetermined ignition time and initializing the starter temperature with the ECU temperature. It is contemplated to use the temperature of an engine fluid, such as oil to coolant, to determine the temperature of the ECU. If the last stored starter temperature and duration of ignition off is less than a predetermined ignition time, the starter temperature is integrated to the ECU temperature by a predetermined time constant. This may be accomplished by passing the sensed starter temperature through a low pass filter to approximate the temperature of the ECU. Once the starter temperature is below a predetermined threshold temperature, the relay switch is closed and the starter is able to be activated. Starter temperature may also be determined by the change in battery voltage between restarting and cranking is determined by subtracting the battery voltage after cranking from the battery voltage at starter rest.

DETAILED DESCRIPTION OF THE PREFERRED EMBODIMENT(S)

Figure 1:
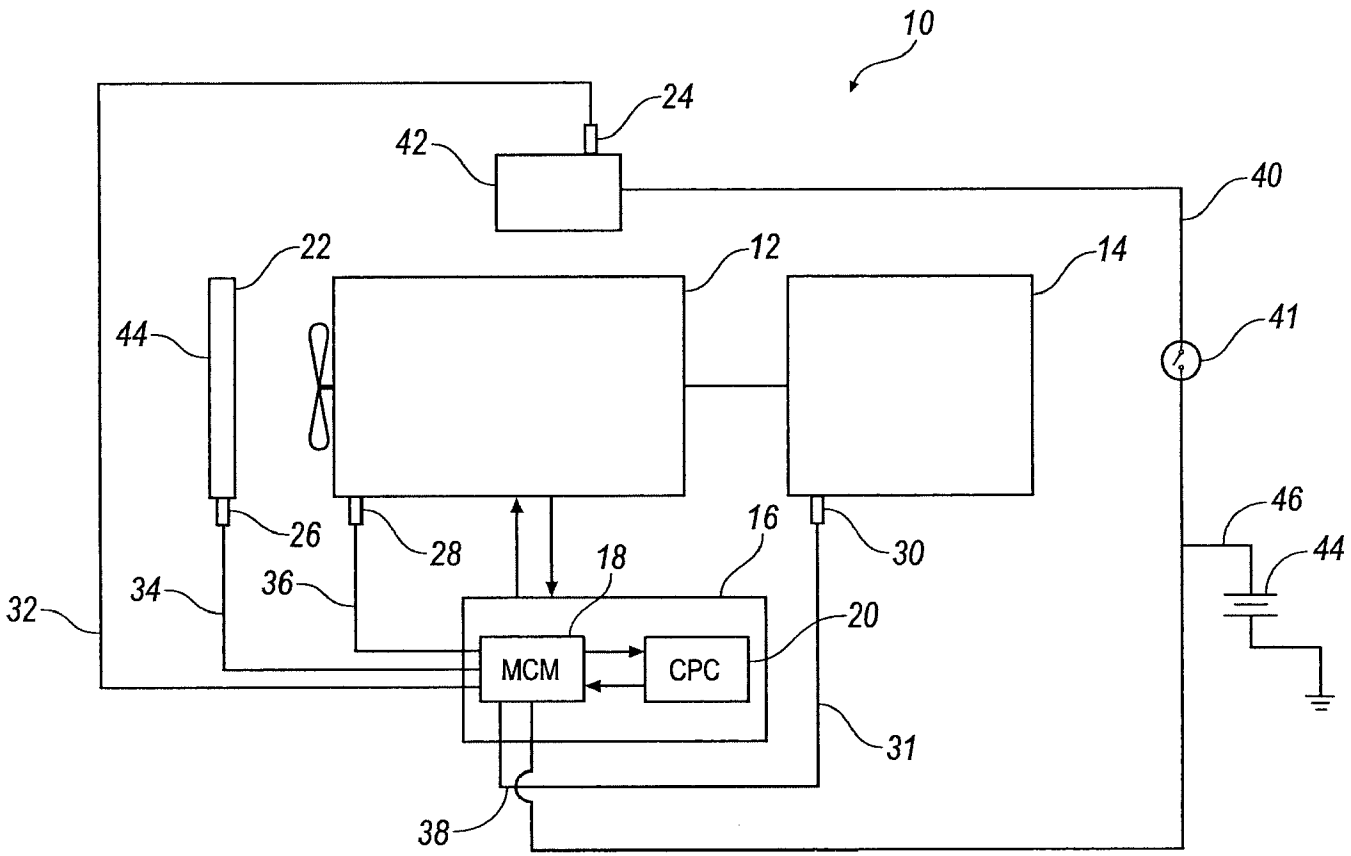
FIG. 1 is a schematic representation of a vehicle drive train system.

Turning now to the drawings wherein like numbers refer to like structures or steps, FIG. 1 is a schematic representation of a vehicle drive train system 10 having an internal combustion engine 12 operably connected to a transmission 14. The system further includes a radiator or other coolant system 22, fluidly connected to the engine to facilitate circulation of coolant in the engine water jacket (not shown). In addition, there may be an oil system (not shown) for the engine that re-circulates oil from a common reservoir and through the engine to lubricate the engine moving parts during operation. The drive train system is preferably an electronically controlled system with an electronic control unit (ECU) 16, having memory therein for storage of operating instructions, tables, values and other information necessary and desired to operate the engine transmission and synchronize operation of the drive train system. While not limited to any single embodiment or operating software, DDEC software, available from Detroit Diesel Corporation is one preferred engine operating software that is contemplated for use in the present disclosure.

The electronic control module may be a single processor unit or may be a dual or multiple process or unit, depending upon the complexity of the operating software and design and engineering directives. The ECU 16 shown in FIG. 1 is a dual processor unit comprising a motor control module 18 (MCM) wherein reside the operating instruction for the operation of the engine, and the Common Processor Unit (CPU) 20 for control and operation of the transmission. These processors communicate with each other through a common area network (CAN) 21, so that information may be integrated between the operation of the engine and the operation of the transmission in a manner well known to those skilled in the art. The ECU communicates with the various vehicle components via a CAN network 23.

The engine is further equipped with a starter 42 which is engageably connected to the engine to crank the engine for starting purposes. The starter is electronically connected to an ignition switch 41, which is, in turn electronically connected to the MCM to facilitate the counting of ignition events. The starter and ignition switch are connected to the battery 44 through electrical connection 46. the starter has a temperature sensor 24, electrically connected to the MCM by connection rout 32, and the coolant system 22 shown as a radiator, has a temperature sensor 26 electronically connected to the MCM by connection rout 34. similarly, the engine has an oil temperature sensor 28, electronically connected to the MCM by connection rout 36 and the transmission had a transmission fluid temperature sensor 30, which is connected to the MCM or the CPC by connection route 31 to facilitate transmission of temperature information to the MCM.

The MCM has a memory for storage of tables with data indicating temperatures from each of the components from which temperature readings have been obtained to assist in the approximation of the ECU temperature The memory may be FLASH, PROM, EEPROM or any other memory that may assist in the storage of data. The table may contain various engine control data, and in this embodiment may include tables to assist in the approximation of the ECU temperature based upon the temperature of the engine fluids, such as engine coolant or engine oil. In addition, there is a table for storing the last ignition event, the time duration of the starter activation event, past ignition time events may be stored. It is also contemplated that the past ignition time events or duration of starter engagement time count be re-settable, so that the system has a wide flexibility of application. In addition, the memory may contain predetermined temperature thresholds for the starter temperature, above which the starter is disabled.

The ECU may also include algorithms to facilitate approximation of ECU temperature based upon the sensed temperature of the various engine fluids, as well as timers and low pass filters and attendant circuitry.

Figure 2:
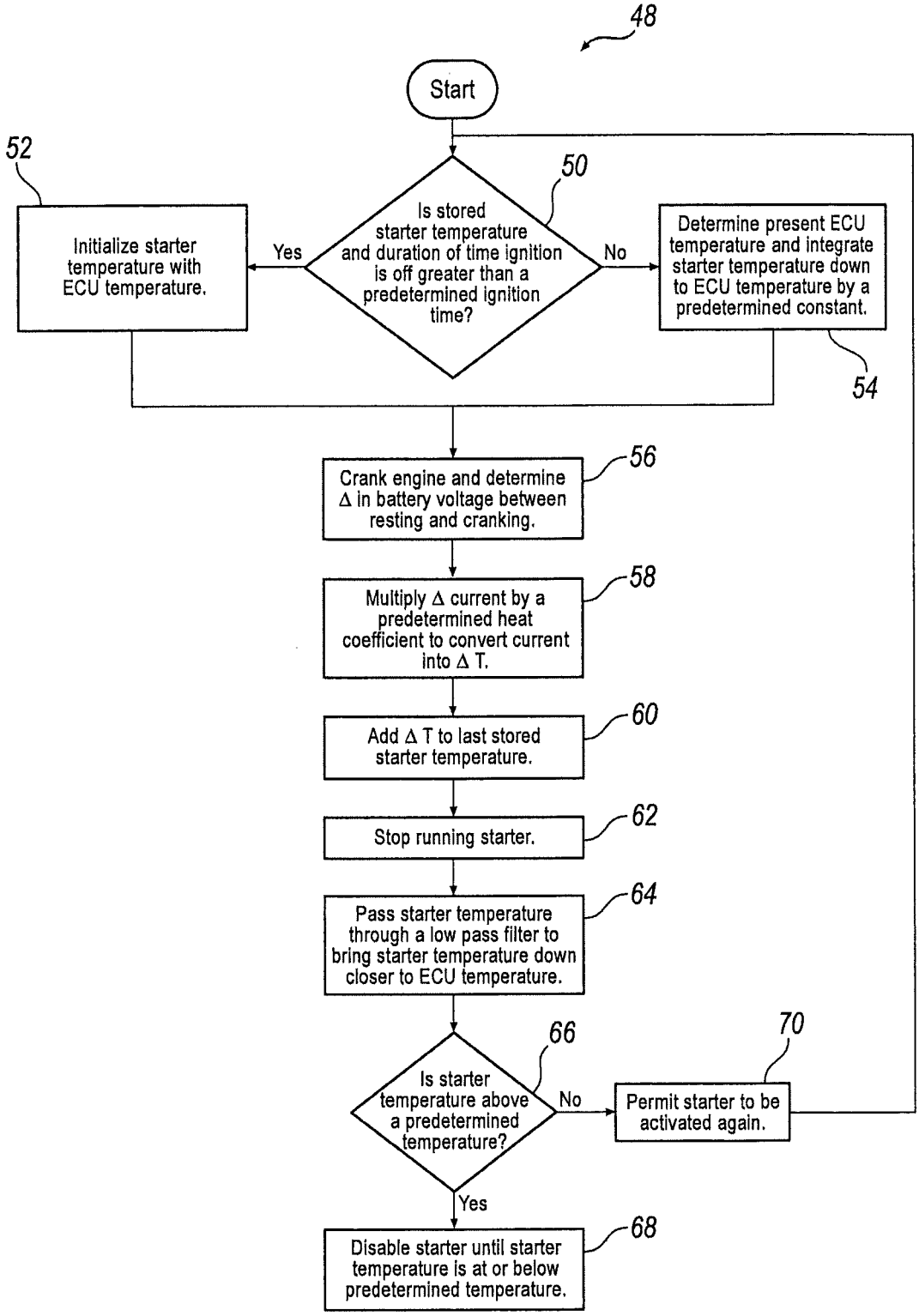
FIG. 2 is a schematic representation of one embodiment of the method of the present disclosure.

Turning now to FIG. 2, there is shown a schematic representation of a method 48 for one embodiment of the present disclosure. Step 50 is detaining whether the starter temperature and the duration of time of ignition is off is greater than a predetermined ignition time. If the determination is yes, then step 52 is initializing the starter temperature with the ECU temperature. Generally, this may be accomplished by determining the temperature of an engine fluid, such as oil or coolant, and thereby approximating the temperature of the ECU. If the determination in step 50 is no, then step 54 is determine the present ECU temperature and integrate starter temperature down to the ECU temperature by a predetermined constant, which is a programmable value stored in memory. In either case, both steps 52 and 54 proceed to step 56, which is initiating starter, cranking the engine and determining the change in battery voltage between resting and starter cranking. This may be accomplished by resort to Shepherd's Relation, $$V=V_{oc}\times K[Q/(Q-it)]1-Nl$$

Wherein
V=battery voltage
$V_{oc}$=constant potential
K=coefficient of polarization
Q=amount of active material
l=current density
t=time since start of discharge
N=internal resistance Once the change in battery voltage is determined as set forth instep 56, step 58 is multiplying the change in current by a predetermined heater coefficient convert the change of current into a change in temperature. Step 60 is adding the change in starter temperature to the last stored starter temperature and step 62 is ceasing operation of the starter. Step 64 is passing the starter temperature the=rough a low pass filter to bring the starter temperature down closer to the ECU temperature. Step 66 is determining whether the starter temperature is above a predetermined temperature. If yes, step 66 is disabling the starter until the starter temperature is below a predetermined temperature. If the determination in step 66 is no, step 70 is permitting the starter to be activated for a predetermined period of time and the software loops back to step 50.

While various aspects of the disclosure have been detailed, those skilled in the art recognize that the words used are words of description, not words of limitation. Many variations and modifications are possible without departing form the scope and spirit of the invention as set forth in the appended claims.

We claim:

1. A method to protect a starter from overheating during cranking operations preparatory to starting an electronically controlled internal combustion engine having an electronic control unit (ECU), and at least one temperature sensor, an ignition switch, a battery connected to a starter and a relay switch between the battery and the starter, comprising:

a) determining whether the starter temperature and duration of time an ignition switch is in the "off" position is greater than a predetermined ignition time;

based on a prior crank event;

b) approximating the starter temperature with ECU temperature;

c) cranking the starter and determining a change in battery voltage between resting and cranking to a change in current;

d) multiply the change in current by a predetermined coefficient to convert to a change in temperature and add to the change in temperature to a last starter temperature stored in memory;

e) ceasing starter operation and bringing starter temperature to approximate ECU temperature;

f) disabling the starter if the starter temperature is above a predetermined temperature until the starter is at or below said predetermined temperature.

2. The method of claim 1, wherein if last stored starter temperature and duration of ignition is greater than a predetermined ignition time, the starter temperature is initialized with the ECU temperature.

3. The method of claim 1, wherein if the last stored starter temperature and duration of ignition off is less than a predetermined ignition time, the starter temperature is integrated to the ECU temperature by a predetermined time constant.

4. The method of claim 1, wherein engine fluid temperature is used to determine ECU temperature.

5. The method of claim 4, wherein said engine fluid is oil.

6. The method of claim 1, wherein said starter is disable for a period of time approximately fewer times greater than the time during which the started is cranked.

7. The method of claim 1, wherein the prior crank event is measured by a countdown time delay that is not reset until a next ignition event.

8. The method of claim 1, wherein the change in battery voltage between restarting and cranking is determined by accelerating the battery voltage after cranking from the battery voltage at starter rest.

9. The method of claim 1, wherein said starter temperature is brought to approximately ECU temperature by passing the starter temperature through a low pan filter.

10. The method of claim 1 wherein the starter is enabled if starter temperature is below a predetermined temperature threshold.

11. The method of claim 1, wherein said starter is disabled by opening a relay switch between the battery and the starter.

12. The method of claim 1, wherein the change in battery voltage is made using the formula:

$$V=V_{oc}\times K[Q/(Q-it)]1-Nl$$

Wherein

V=battery voltage $V_{oc}$=constant potential

K=coefficient of polarization

Q=amount of active material l=current density t=time since start of discharge

N=internal resistance.

* * * * *